US006187104B1

(12) United States Patent
Bozarjian

(10) Patent No.: US 6,187,104 B1
(45) Date of Patent: Feb. 13, 2001

(54) CLEANING IMPLEMENT AND METHOD

(76) Inventor: Karyne Bozarjian, 100 Elm St. #2, Marblehead, MA (US) 01945

( * ) Notice: Under 35 U.S.C. 154(b), the term of this patent shall be extended for 0 days.

(21) Appl. No.: 09/160,394

(22) Filed: Sep. 25, 1998

(51) Int. Cl.[7] ..... A46B 5/02

(52) U.S. Cl. ..... 134/6; 15/160; 15/106; 15/246

(58) Field of Search ..... 15/105, 106, 159.1, 15/160, 161, 246, 244.1; 24/3.13, 298, 300, 301, 302; 134/6; 248/213.2, 693, 683; D4/116, 130, 132, 199

(56) References Cited

U.S. PATENT DOCUMENTS 3,905,610 * 9/1975 Dini ..... 24/302
4,361,934 * 12/1982 Darnell ..... 24/302
4,765,037 * 8/1988 Perry ..... 24/301
5,230,117 * 7/1993 Johnson et al. ..... 15/161
5,555,589 * 9/1996 Moultrie ..... 15/160
5,615,454 * 4/1997 Contarino ..... 24/3.13
5,722,125 * 3/1998 Vasilopoulos ..... 24/301
5,815,873 * 10/1998 Jones ..... 15/161
5,884,371 * 3/1999 Huggins ..... 24/301

* cited by examiner

*Primary Examiner*—Terrence R. Till
(74) *Attorney, Agent, or Firm*—Mintz, Levin, Cohn, Ferris Glovsky and Popeo, P.C.

(57) ABSTRACT

A cleaning implement includes a mount and a wiping element connected to the mount. The implement can be mounted on a fixed surface in an establishment where smokers engage in smoking, and used to wipe ashtrays used by the smokers.

29 Claims, 3 Drawing Sheets

CLEANING IMPLEMENT AND METHOD

FIELD OF THE INVENTION

This application relates to cleaning implements, and more particularly to cleaning brushes and the like that are suitable for cleaning receptacles such as ashtrays, as well as to mounted cleaning implements which can be readily washed in dishwashers.

BACKGROUND OF THE INVENTION

Bartenders and other wait-staff can be highly pressed for time. They typically must respond to orders from rushed wait staff and/or customers while at the same time keeping their work areas stocked and cleaned. To this end, bartenders and other wait-staff frequently use stacks of cocktail napkins to quickly clean ashtrays at the bar. These napkins represent an expense to the establishment, need to be restocked, and increase the amount of waste that the establishment generates.

SUMMARY OF THE INVENTION

In one general aspect, the invention features a cleaning implement that includes a mount and a wiping element connected to the mount. The wiping element includes a handle, and a wiping section with first and second ends. The first end of the wiping section is connected to the handle, and the first and second ends are separated by at least about one inch. The wiping section has a working surface that has a maximum dimension of less than about six inches.

In preferred embodiments, the cleaning implement can include a tether connected between the mount and the wiping element to connect the mount and the wiping element. The tether can be extensible, such as from a length of less than about six inches to a length of more than about twelve inches. The handle can be made of injection-molded plastic, with the wiping section including bristles, and with the bristles connected to the handle by embedding them in the handle. The wiping section can be made of a machine-washable material. A detachable coupling can be provided between the mount and the wiping section. The first and second ends can be separated by at least about two inches or even about three inches. The wiping section can be reversibly bendable by at least 60, 90, or even 135 degrees. An advertising area can be located on the implement. The mount can be a magnet connected to the handle. The mount can be a clip connected relative to the handle. The working surface of the wiping section can be about two inches wide or less.

In another general aspect, the invention features a cleaning implement that includes a mount and a wiping element. The wiping element includes a handle, and a wiping section made of a machine-washable material. A detachable coupling is provided between the mount and the wiping section.

In preferred embodiments, the wiping section can be resistant to water, detergents, and temperatures above about 140 degrees F. The cleaning implement can include a tether connected between the mount and the wiping element to connect the mount and the wiping element. The tether can be extensible. The handle can be made of injection-molded plastic, with the wiping section including bristles, and with the bristles connected to the handle by embedding them in the handle. The handle can be made of wood treated with a water-proof coating. An advertising area can be located on the implement. The mount can be a magnet connected to the handle.

In a further general aspect, the invention features a cleaning implement for cleaning ashtrays that includes wiping element means that includes means for holding the wiping element with one hand, and means for wiping an ashtray connected to the means for holding. The cleaning implement also includes means for attaching the wiping element to a refuse container. In preferred embodiments, the means for wiping can be machine-washable, and the cleaning implement can further include means for detachably attaching the wiping element means to the refuse container.

In another general aspect, the invention features a method of cleaning ashtrays that includes providing a wiping implement, mounting the wiping implement on a fixed surface in an establishment where smokers engage in smoking, and using the wiping element to wipe ashtrays used by the smokers.

In preferred embodiments, the method can further include the step of washing the wiping element in a dishwasher. The method can further include the step of providing a mounting element attached to the wiping element, with the step of mounting the wiping element employing the mounting element to mount the wiping element. The method can further include the step of detaching the wiping element from the mounting element. The method can further include the step of washing the wiping element in a dishwasher. The step of mounting can include clipping the wiping element to a refuse barrel. The step of providing can provide an advertising area on the wiping implement that supports advertising content.

Brushes according to the invention can be advantageous in that they can allow bartenders to quickly and efficiently clean ashtrays. Because the bartenders and others charged with cleaning such receptacles have a cleaning implement close at hand and easily storable, they can quickly clean one or more ashtrays during a few-second period between other tasks. This can be done without cocktail napkins, which have to be paid for, disposed of, and then restocked. Brushes according to the invention may also be advantageous in that they can be easily cleaned in a dishwasher.

DETAILED DESCRIPTION OF AN ILLUSTRATIVE EMBODIMENT

Figure 1:
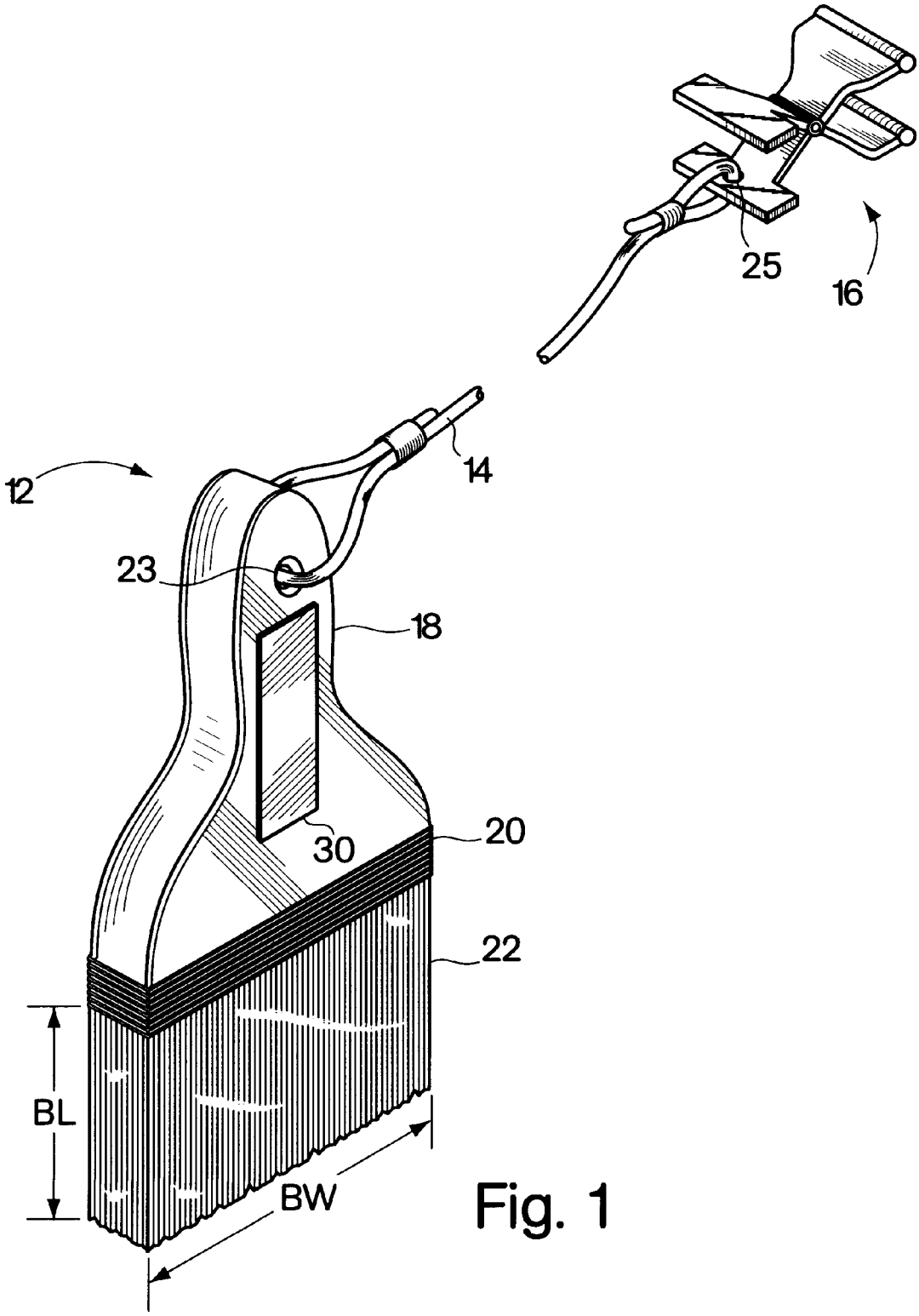
FIG. 1 is a perspective drawing of a cleaning implement according to the invention.

Referring to FIG. 1, a cleaning implement according to the invention can include a wiping element 12, a tether 14, and a mount 16. The wiping element 12 can include a handle 18 and a wiping portion 22 attached to a distal end of the handle. The wiping element can be a brush in which the wiping portion including bristles attached to it via a fastening mechanism 20 (e.g., a ferrule). The brush can include a generally rectangular bundle of bristles, although other geometric configurations can also be used, such as radially extending bristles extending from a curved surface. The wiping element need not be a brush, however, and can instead employ a sponge, cloth, or other suitable type of wiping portion. The wiping portion may be fixed to the handle, or it can be removable from the rest of the implement. In one embodiment the brush includes a relatively rigid injection-molded plastic handle with flexible plastic bristles that each have one end embedded in a distal end of the handle. A wooden handle with a water-proof coating can also be used. Brushes with such treated handles are Sparta Brush Company, Sparta, Wis.

The tether 14 can be attached to a proximal end of the handle 18, such as by passing a portion of it through a hole 23 in the handle. The tether can include an elastic strap, a rigid strap, a chain, a rigid strap with a spooling mechanism, or any other suitable structure. Preferred guidelines for extended and unextended lengths of the strap are discussed below.

The mount 16 can be a spring-loaded clamp (see FIG. 1), a magnet (see FIG. 2), a U-shaped leaf-spring clip (see FIG. 3), a screw clamp, an adhesive, a permanent fastener, a hook, or any other element suitable for mounting the implement on the upper edge of a refuse barrel or other appropriate location within the environment in which the implement is to be used. The mount can be connected to the tether 14, such as by passing a portion of the tether through a hole 25.

In order to clean an ashtray well and efficiently, the length of the wiping section BL is preferably relatively long, the aggregate flexibility of the bristles should be fairly high, and a width BW of a working surface of the wiping section should be relatively short. These properties allow the implement to be used to clean out fairly deep ashtrays and to conform to the contours of the ashtray. To this end, the bristles should be one inch long, preferably at least two inches long, or even three inches long. The bristles should have an aggregate flexibility permitting them to be reversibly bent at least 60 degrees, preferably 90 degrees, or even 135 degrees. The width of the working surface should be less than about six inches, preferably less than three inches.

Figure 2:
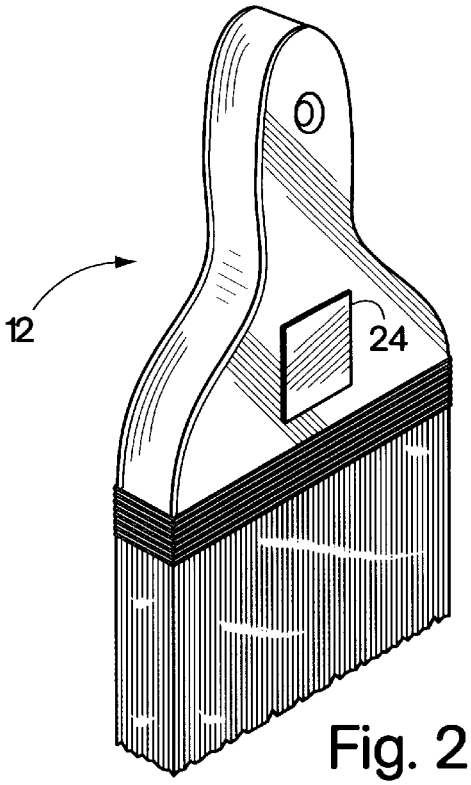
FIG. 2 is a perspective drawing of an alternative embodiment of a cleaning implement according to the invention.

Referring to FIG. 2, an alternative embodiment of the cleaning implement includes a wiping element 12 attached to a magnet 24. The magnet allows the cleaning implement to be attached to a metallic refuse barrel, or other metal surface in the area of use. The magnet can be coated or otherwise treated to avoid rusting.

Figure 3:
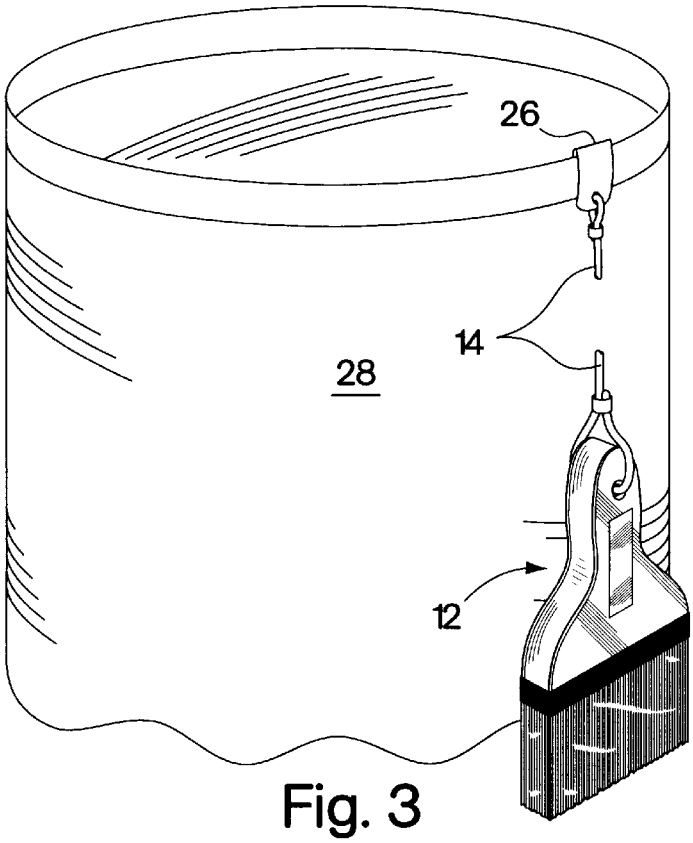
FIG. 3 is a perspective drawing of a second alternative embodiment of a cleaning implement according to the invention, shown attached to a waste barrel.

Referring to FIG. 3, a cleaning implement according to the invention can be attached to a trash barrel 28, by its mount (e.g., made of a resilient U-shaped clip 26 spring steel or plastic). This allows the implement to hang next to the barrel or in another convenient location. A user, such as a bartender or custodian, can then easily grasp the cleaning implement in one hand, hold an ashtray in the other hand, and wipe the contents of the ashtray into the barrel. Once the ashtray is clean, the user can quickly return it to its mounted position, such as by simply letting go of it. Note that the tether can be one of a number of lengths, but that in its unextended position it is preferable that it allows the handle to sit in a position that is easy to grasp, and in its extended position it is preferable that it allows the brush to be easily held above the barrel and moved around the ashtray in that position, so that the ashtray can be easily wiped. To this end, the tether ranges in one embodiment between less than six inches (unextended) and more than twelve inches (extended) in length.

Figure 4:
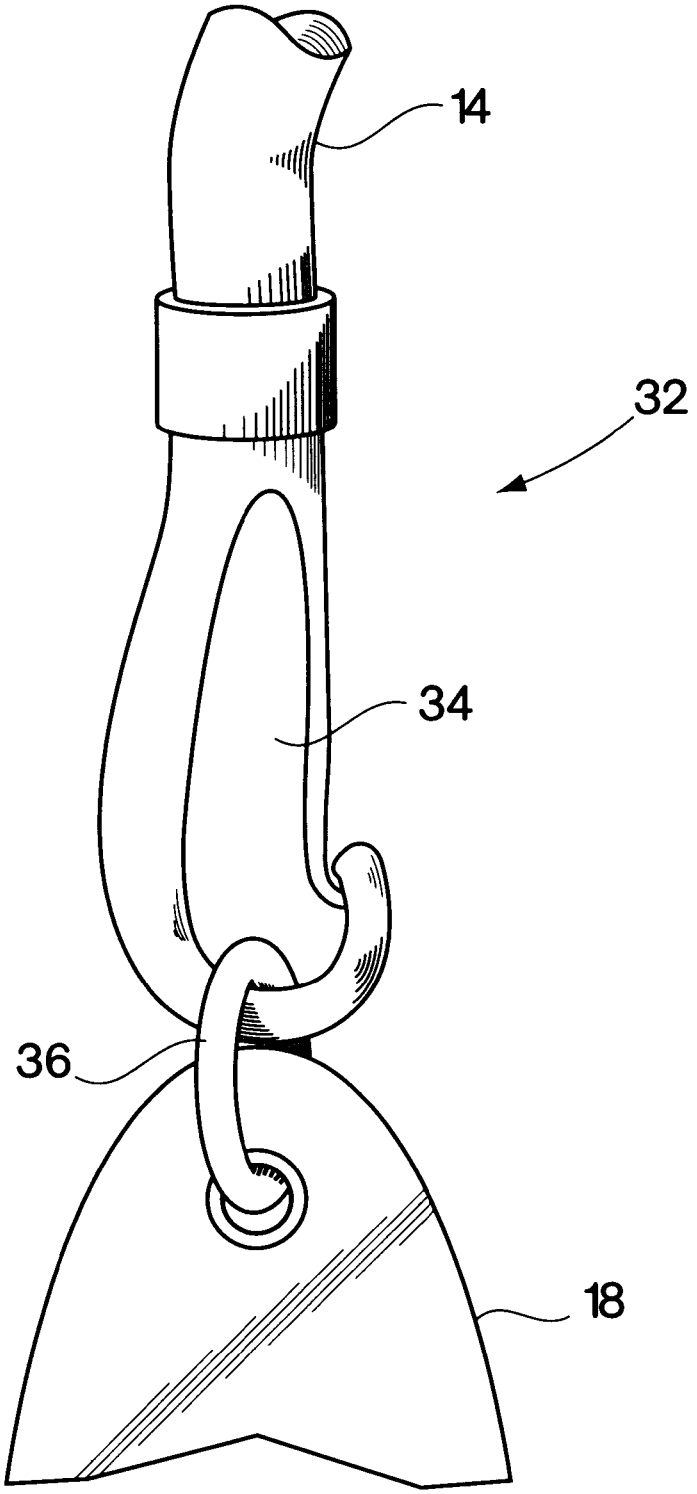
FIG. 4 is a perspective drawing of a detachable coupling usable in the implements of FIGS. 1 and 3.

Referring to FIGS. 1, 2, and 4, the tether 14 can be detachably attached to the wiping element 12 or the mount 16, such as by a detachable coupling 32. The detachable coupling can include a clip 34 that is connected to the tether and that interacts with a fixed ring 36 that is connected to the wiping element 18 or mount via a hole. Other detachable couplings are also suitable, such as s-rings, split rings, hook-and-loop fasteners, and magnetic couplings.

The detachable coupling 32 can allow the wiping element to be removed from the implement and placed in a dishwasher, such as in a tray with other items in a food-service grade dishwasher. If the wiping section is detachable by itself, it may be washed separately. It may also possible to wash the entire implement 10 in a dishwasher. In one embodiment, the implement is resistant to repeated exposures to water, detergents and temperatures above 140° F.

In one embodiment, an advertising area 30 is provided for advertising inscriptions. Since the trash barrel is frequently placed behind the bar, or in another visible location, the implement can support a commercial message which the bartender and customers will be likely to see frequently.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto. In addition, the order of presentation of the claims should not be construed to limit the scope of any particular term in the claims.

What is claimed is:

1. A cleaning implement, comprising:

a mount, a wiping element connected to the mount and comprising:

a handle, and a wiping section having first and second ends, the first end of the wiping section being connected to the handle, the first and second ends being separated by at least about one inch, the wiping section having a working surface, the working surface of the wiping section having a maximum dimension of less than about six inches, wherein the wiping section is reversibly bendable by at least about 90 degrees.

2. The cleaning implement of claim 1 further including a tether connected between the mount and the wiping element to connect the mount and the wiping element.

3. The cleaning implement of claim 1 wherein the tether is extensible.

4. The cleaning implement of claim 3 wherein the tether is extensible from a length of less than about six inches to a length of more than about twelve inches.

5. The cleaning implement of claim 1 wherein the handle is made of injection-molded plastic, wherein the wiping section includes bristles and wherein the bristles are connected to the handle by embedding them in the handle.

6. The cleaning implement of claim 1 wherein the wiping section is made of a machine-washable material.

7. The cleaning implement of claim 1 further including a detachable coupling between the mount and the wiping section.

8. The cleaning implement of claim 1 wherein the first and second ends are separated by at least about two inches.

9. The cleaning implement of claim 1 wherein the first and second ends are separated by at least about three inches.

10. The cleaning implement of claim 1 further including an advertising area located on the implement.

11. The cleaning implement of claim 1 wherein the mount is a magnet connected to the handle.

12. The cleaning implement of claim 1 wherein the mount is a clip connected relative to the handle.

13. The cleaning implement of claim 1 wherein the working surface has a maximum dimension of about two inches or less.

14. A cleaning implement, comprising:

a mount, a wiping element connected to the mount and comprising:

a handle, and a wiping section having first and second ends, the first end of the wiping section being connected to the handle, the first and second ends being separated by at least about one inch, the wiping section having a working surface, the working surface of the wiping section having a maximum dimension of less than about six inches, wherein the wiping section is reversibly bendable by at least about 135 degrees.

15. A cleaning implement, comprising:

a mount, a wiping element comprising:

a handle made of wood treated with a water-proof coating, and a wiping section made of a machine-washable material, and a detachable coupling between the mount and the wiping section.

16. The cleaning implement of claim 15 wherein the wiping section is resistant to water, detergents, and temperatures above about 140 degrees F.

17. The cleaning implement of claim 15 further including a tether connected between the mount and the wiping element to connect the mount and the wiping element.

18. The cleaning implement of claim 15 wherein the tether is extensible.

19. The cleaning implement of claim 15 further including an advertising area located on the implement.

20. A cleaning implement for cleaning ashtrays, comprising:

wiping element means, comprising:

means for holding the wiping element with one hand, and means for wiping an ashtray connected to the means for holding, and means for attaching the wiping element to a refuse container.

21. The cleaning implement of claim 20 wherein the means for wiping is machine-washable.

22. The cleaning implement of claim 20 further including means for detachably attaching the wiping element means to the refuse container.

23. A method of cleaning ashtrays, comprising:

providing a wiping implement, mounting the wiping implement on a fixed surface in an establishment where smokers engage in smoking, and using the wiping element to wipe ashtrays used by the smokers.

24. The method of claim 23 further including the step of washing the wiping element in a dishwasher.

25. The method of claim 23 further including the step of providing a mounting element attached to the wiping element, wherein the step of mounting the wiping element employs the mounting element to mount the wiping element.

26. The method of claim 25 further including the step of detaching the wiping element from the mounting element.

27. The method of claim 26 further including the step of washing the wiping element in a dishwasher.

28. The method of claim 23 wherein the step of mounting includes clipping the wiping element to a refuse barrel.

29. The method of claim 23 wherein the step of providing provides an advertising area on the wiping implement supporting advertising content.

* * * * *